US010286538B2

(12) United States Patent
Wen et al.

(10) Patent No.: US 10,286,538 B2
(45) Date of Patent: May 14, 2019

(54) SELF-ADJUSTING NESTED TOOL HEAD

(71) Applicant: TELEHEX INC., Toronto (CA)

(72) Inventors: Peter Huiqin Wen, Toronto (CA); Calvin Michael Moes, Mississauga (CA)

(73) Assignee: TELEHEX INC., Toronto (CA)

( * ) Notice: Subject to any disclaimer, the term of this patent is extended or adjusted under 35 U.S.C. 154(b) by 0 days.

(21) Appl. No.: 15/748,452

(22) PCT Filed: Jul. 25, 2016

(86) PCT No.: PCT/CA2016/050875
§ 371 (c)(1),
(2) Date: Jan. 29, 2018

(87) PCT Pub. No.: WO2017/015754
PCT Pub. Date: Feb. 2, 2017

(65) Prior Publication Data

US 2018/0222031 A1 Aug. 9, 2018

Related U.S. Application Data

(60) Provisional application No. 62/198,196, filed on Jul. 29, 2015.

(51) Int. Cl.

| | |
|---|---|
| ***B25F 1/04*** | (2006.01) |
| ***B25B 13/10*** | (2006.01) |
| ***B25B 13/56*** | (2006.01) |
| ***B25B 15/00*** | (2006.01) |
| *B25G 1/08* | (2006.01) |

(52) U.S. Cl.
CPC ..... *B25F 1/04* (2013.01); *B25B 13/102* (2013.01); *B25B 13/56* (2013.01); *B25B 15/008* (2013.01); *B25G 1/085* (2013.01)

(58) Field of Classification Search
CPC ..... B25B 13/102; B25B 13/56; B25B 15/008; B25G 1/085; B25F 1/04
See application file for complete search history.

(56) References Cited

U.S. PATENT DOCUMENTS

| | | | |
|---|---|---|---|
| 1,896,949 | A | 2/1933 | Greiner |
| 1,997,948 | A | 4/1935 | Pearson |
| 2,660,082 | A | 8/1952 | Dreese |
| 2,735,325 | A | 2/1956 | Rudd, Sr. |
| 2,822,714 | A | 2/1958 | Paparelli |
| 3,127,798 | A | 4/1964 | Gol |
| 3,651,720 | A | 3/1972 | Indyk |
| 2015/0217432 | A1 | 8/2015 | Gadd |

OTHER PUBLICATIONS

International Search Report and Written Opinion dated Sep. 28, 2017 for PCT/CA2016/050875.

*Primary Examiner* — David B. Thomas
(74) *Attorney, Agent, or Firm* — Ridout & Maybee LLP

(57) ABSTRACT

A tool head. The tool head includes an inner core and a plurality of nested shells fitted over the inner core. Each shell is engaged with the inner core at a proximal end. Each shell is independently biased towards the distal end of the inner core and independently compressible away from the distal end. Each shell is independently slidable relative to the inner core and relative to each other. A handle may be used to provide additional leverage and to fold over the tool head when the tool head is not in use.

13 Claims, 7 Drawing Sheets

SELF-ADJUSTING NESTED TOOL HEAD

CROSS-REFERENCE TO RELATED APPLICATION(S)

This application is a U.S. nationalization under 35 U.S.C. § 371 of International Application No. PCT/CA2016/050875 filed Jul. 25, 2017 entitled TOOL HEAD, which claims the benefit of priority to U.S. Provisional Patent Application No. 62/198,196 filed Jul. 29, 2015 entitled TOOL HEAD, all the contents of which are herein incorporated by reference into the below DETAILED DESCRIPTION OF EXAMPLE EMBODIMENTS.

FIELD

Example embodiments are related to tool heads for engaging with sockets. In particular, at least some example embodiments are related to adjustable tool heads for engaging with socket fasteners.

BACKGROUND

It is often a challenge for a user to identify and locate the correct tool head size for engaging with a given socket fastener. Conventional tools, such as Allen key sets or hex key sets, are designed such that a single tool head will fit only a single socket size. The result is that the user must either determine the size of a given socket and select the appropriately-sized tool, or else must use trial-and-error to find the tool that matches the size of the socket.

It may be advantageous to provide a single tool head that is usable for multiple socket sizes.

SUMMARY

In some examples, there is provided a tool head. The tool head includes: an inner core having a proximal end and a distal end, and defining a longitudinal axis; and a plurality of nested shells fitted over the inner core and substantially sharing the longitudinal axis of the inner core, each shell being engaged with the inner core at a proximal end, and each shell being independently biased towards the distal end of the inner core and independently compressible away from the distal end; wherein each shell is independently slidable relative to the inner core and relative to each other.

BRIEF DESCRIPTION OF THE DRAWINGS

Reference will now be made, by way of example, to the accompanying drawings which show example embodiments, and in which.

Similar reference numerals may have been used in different figures to denote similar components.

DETAILED DESCRIPTION OF EXAMPLE EMBODIMENTS

In various examples, there is provided a tool head capable of self-adjusting to adapt to the size of socket fasteners with which it is used to apply torque to. In some examples, the tool head includes a solid core, a set of nested tubular shells, and a set of biasing members (e.g., springs). The solid core is a single body, which may have steps having various cross-sectional sizes. In examples where the tool head is designed to engage with hexagonal sockets, the solid core may include steps of hexagonal cross sections of various sizes.

Tubular shells with external contours, which conform to the internal contour of the sockets the tool head is designed to turn, engage slidably with its corresponding step of the solid core as well as with any shells nested within it. Each shell may remain substantially in contact with a coiled compression spring which is substantially in contact on the opposite end with a shoulder of the solid core between two steps. Thus, each shell may be pushed distally by its respective spring. The furthest distal position of the shells may be set using a shell retention mechanism, such as one or more sets of pins attached to the shell that extend beyond its interior contour and slide within one or more slots in the solid core, or using any other suitable mechanism.

In various examples, the tool head may automatically self-adjust shell engagement when the tool head is aligned and pressed against an appropriate socket fastener. The tool head may be designed such that sockets of the typical largest size in a configuration may require no adjustment of shell positions (i.e., the tool head may be used in its default or uncompressed configuration). The flat face of the barrel of smaller sockets fasteners may depress shells that are too large to fit in the socket, exposing the shell with the correct outer contour, which engages with the socket and allows for torquing of the socket fastener using the tool head.

Figure 1:
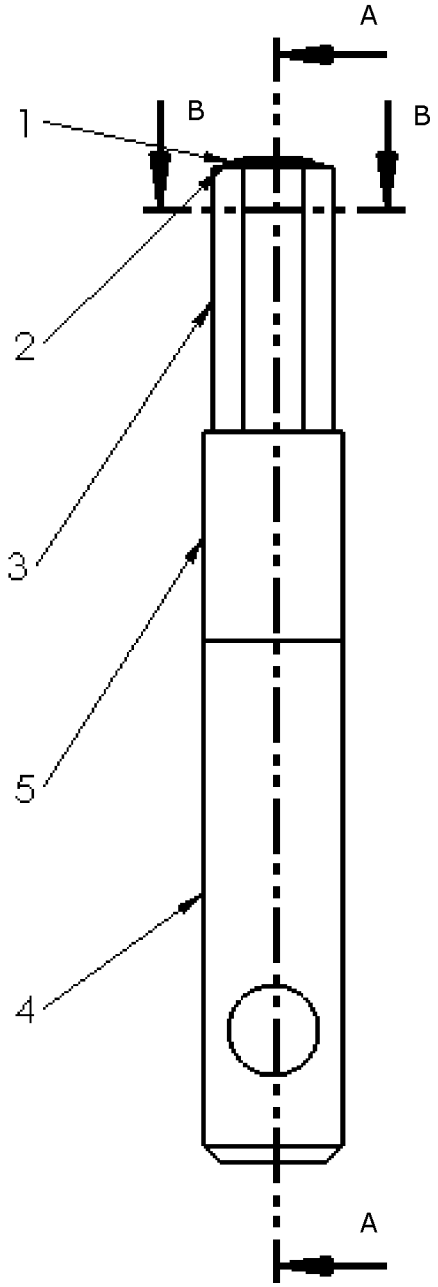
FIG. 1 is a side view of an example tool head, according to an example embodiment.
Figure 2:
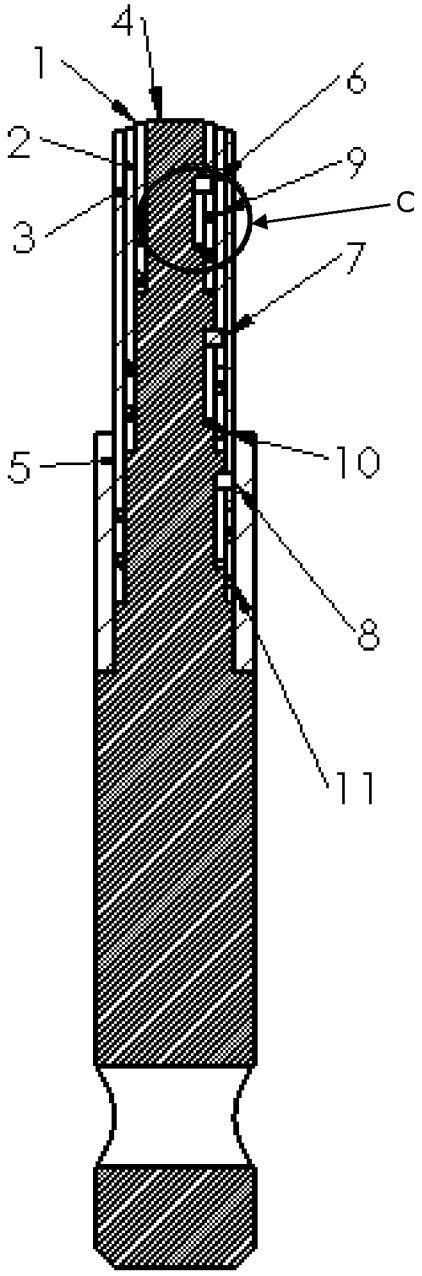
FIG. 2 is a cross-sectional view of the example tool head of FIG. 1, taken lengthwise along line A-A.

Reference is now made to FIGS. 1 and 2. In the example embodiment shown, the tool head is dimensioned for use on metric hex sockets. However, it will be recognized that in other examples the tool head may be constructed and dimensioned for use on a variety of different sized and shaped bolts including but not limited to imperial hex sockets and square fasteners, among others, in other example embodiments.

In an example embodiment, the default or rest uncompressed configuration is illustrated in FIGS. 1 and 2. The example tool head is illustrated oriented with its distal end towards the top and its proximal end towards the bottom. The tool head may engage with a socket at its distal end.

In the example shown, the tool head includes three shells 1, 2, 3, however in other examples there may be more or less shells present. The shells 1, 2, 3 may have face-to-opposite-face (also referred to herein as width) measurements of about 4 mm, 5 mm and 6 mm, respectively. The shells may be arranged over an inner core 4 having, at its distal end, a width of about 3 mm, and increasing in size stepwise, as shown in the figures and as discussed below. The shells 1, 2, 3 may have a hexagonal cross-section, for engaging a hexagonal socket. Such dimensions may be suitable for engaging with typical sockets found commonly on bicycles, for example, although the tool head may not be limited in example embodiments. Generally, the size and shapes of the shells may be designed to match the size and shapes of the sockets with which the tool head is expected to engage.

In the example shown, the innermost shell 1 (which may be smallest-sized shell) with a thru bore engages slidably with the corresponding section of the solid core 4 as well as with the corresponding bore of the next shell 2. A biasing member, such as a coil spring 9, pushes against the shoulder of the core 4, wraps around the smallest corresponding section of the core 4, is contained within the bore of the next shell 2, and applies force on the proximal end of the innermost shell 1 towards the distal direction. In the example where the tool head is designed to engage with a hexagonal shaped socket, the bores of each of the shells 1, 2, the core 4, and the shape of the coil spring 9 may all be correspondingly hexagonal.

In the uncompressed configuration, the distal end of the innermost shell 1 may be slightly recessed from the distal end of the core 4. In other examples, the innermost shell 1 may be substantially flush with the distal end of the core 4. This position of the innermost shell 1, in the uncompressed configuration, may be the most distal position that the shell 1 may slide.

Figure 3:
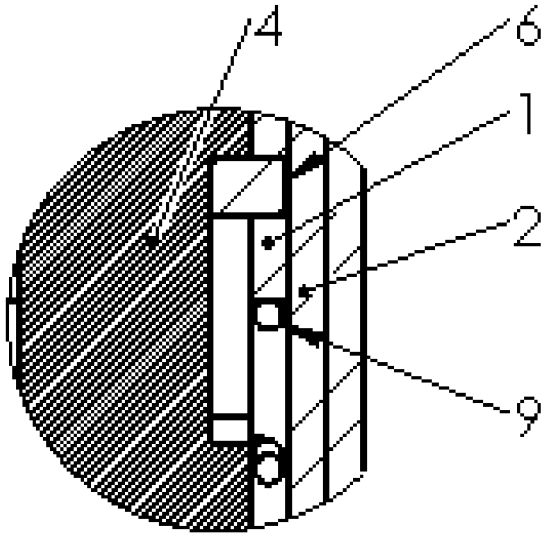
FIG. 3 is a detailed view of an example shell retention mechanism, from portion C of the example tool head of FIG. 2.
Figure 4:
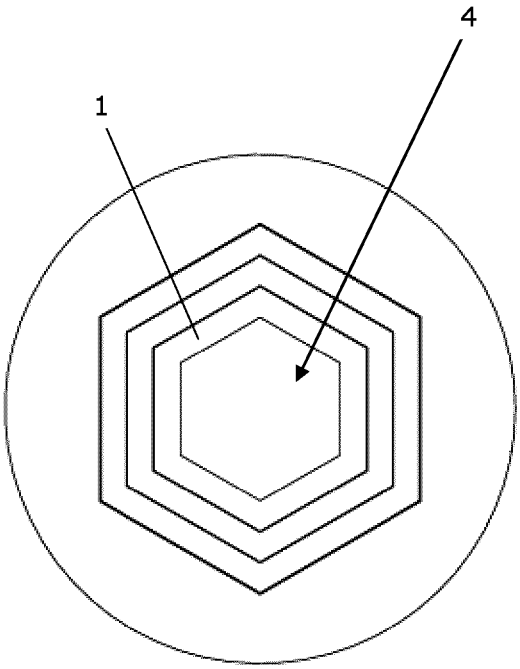
FIG. 4 is a cross-sectional view of the example tool head of FIG. 1, taken perpendicular to the length along line B-B.

FIGS. 3 and 4 illustrate an example mechanism for restricting distal sliding of the shells in the uncompressed configuration. In the example shown, the mechanism includes a pin 6, which is tightly inserted perpendicularly into a hole in a flat face of the shell 1 in a way that the pin 6 stays slightly recessed from the outer face of shell 1. In some examples, the pin 6 may be formed integrally with the shell 1. The pin 6 extends beyond the outer face of the core 4, on which an interior face of shell 1 slides, into a slot running longitudinally down the face of the core 4. The configuration of the slot restricts distal movement of the pin 6, and accordingly also restricts distal movement of the shell 1. For example, the slot and pin 6 may cooperate such that when the pin 6 is at the distal end of the slot, the distal end of the shell 1 is aligned slightly recessed from or substantially flush with the distal end of core 4. The pin 6 which is mated with the shell 1 will resist the upward spring force from the coil spring 9 in this limit position. Thus, movement of the pin 6 along the slot may define and restrict longitudinal movement of the shell 1 along the axis of the tool head. For this example shell retention mechanism, the pin 6 may be inserted through the hole of the shell 1 while the shell 1 is slid onto the core 4 during manufacture. Although an example shell retention mechanism is illustrated and described here, other suitable shell retention mechanisms may be used, such as using a set screw in place of the pin 6, or securing the distal end of the spring 9 to the proximal end of the shell 1 and the proximal end of the spring 9 to the core 4.

Reference is again made to FIG. 2. The shell 2 may function similarly to the innermost shell 1, however the inner face of the shell 2 may engage with the outer faces of both the shell 1 and the core 4. The shell 2 may slide longitudinally on both the exterior surface of the shell 1 and the section of core 4 that corresponds in size with the inside bore of shell 2. Thus, there may be a length of the interior surface of the shell 2 that does not have a flat surface to engage slidably upon; this gap may be occupied by the coil spring 9. Another coil spring 10 pushes against a shoulder of the core 4, wraps around the corresponding section of core 4, is contained within the bore of the next shell 3, and applies force at the proximal end of shell 2 to bias the shell 2 towards the distal direction. Distal movement of the shell 2 may be restricted using a shell retention mechanism, for example comprising a pin 7, such as that described above with respect to the shell 1. In some examples, the most distal position of the shell 2 (which may be when the tool head is in the uncompressed configuration) may have the distal end of the shell 2 recessed from or substantially flush with the distal end of the next inner shell, which is the shell 1.

The configuration and operation of the next outer shell 3, and any other subsequent shells may be substantially similar to that described above for the shell 2. Similarly to the shells 1 and 2, the shell 3 may engage with the core 4 at its proximal end via a spring 11. Distal movement of the shell 3 may be restricted using a shell retention mechanism, for example comprising a pin 8, similar to that described above with respect to the shell 1.

The outermost shell (which is the shell 3 in the example illustrated in FIG. 2) may be contained within and slidable relative to an optional outer container piece 5. The spring 11 acting on the outermost shell 3 may be contained within the container piece 5.

In examples where the container piece 5 is present, the container piece 5 may be a substantially tubular shell (e.g., having a hexagonal bore matching the core 4, in examples where the core 4 has a hexagonal cross-section) and a length that extends at least partway up the exterior of the outmost shell 3. The length of the container piece 5 may be such that it does not limit the engagement of the shell 3 in a socket fastener, for example the container piece 5 may not extend to the distal end of the shell 3. The interior surface of the container piece 5 engages with a portion of the exterior surface of the core and also with a length of the exterior surface of the shell 3. The container piece 5 may be secured to the core 4, e.g., using an adhesive, fastener and/or using a friction fit.

A user may grasp the tool head near its proximal end, e.g., grasping the tool head directly or using a handle coupled near its proximal end, for example as described with respect to FIG. 5 below. The distal end of the tool head may then be pressed against a socket upon alignment of the tool head with the socket. In some examples, an uncompressed configuration of the tool head in which the shells are slightly recessed from the distal end of the core may help to align the tool head with the socket. As the distal end of the tool head is pressed against the socket, any shells that are too large to fit in the socket are pressed away while any shells that fit within the socket are pressed into the socket, thus enabling the tool head to self-adjust to the size of the socket. It should be noted that the smallest socket with which the tool head may engage may be determined by the size of the core at the distal end, e.g, when all shells are pressed away. The tool head thus engages with the socket using the appropriately-sized shell or using the core, ensuring a good fit with the socket. The user may then use the tool head to turn the socket.

In some examples, the tool head may provide a good or sufficient engagement with a socket even where the tool head does not provide an exact match with the size and/or shape of the socket. For example, the self-adjusting characteristic of the tool head may ensure that the tool head provides the best fit possible with the socket, even if the fit is not exact or if the socket is a non-standard size.

Figure 5:
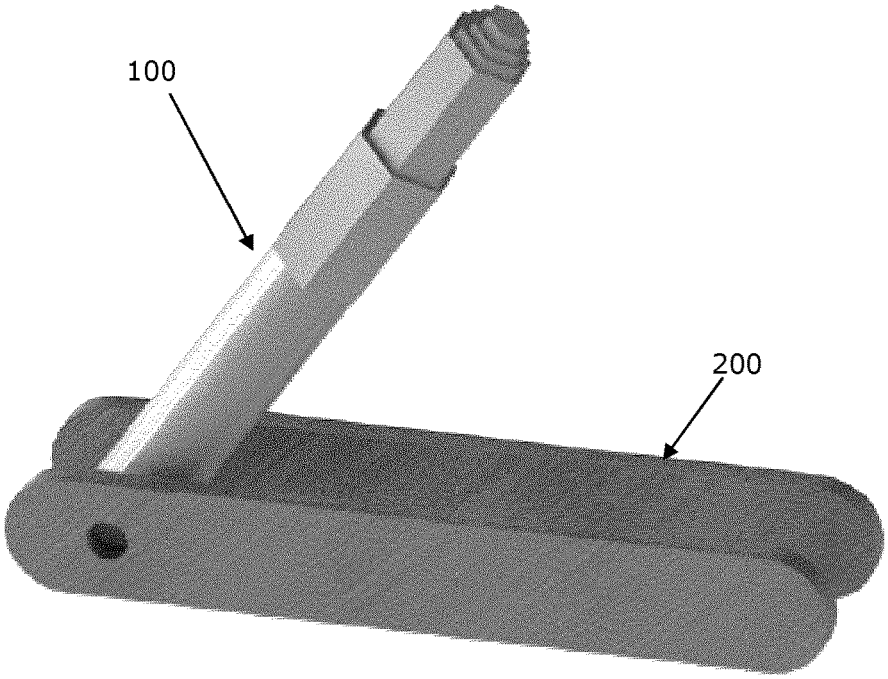
FIG. 5 is a perspective view of the example tool head of FIG. 1, connected to a foldable handle, according to an example embodiment.

FIG. 5 illustrates an example of how an example tool head 100 may be provided with a handle 200. In the example shown, the tool head 100 may be coupled with a handle 200 at or near the proximal end of the tool head 100. The coupling may be a rotatable coupling about a first axis, such that the handle 200 may fold over the tool head 100 when the tool head 100 is not in use. The handle 200 may serve to protect the tool head 100 from dust and/or damage when not in use, for example. The handle 200 may also fold out, to be orthogonal to or parallel to the longitudinal axis of the tool head 100, which may provide better leverage for a user to turn the tool head 100 when the tool head 100 is engaged with a socket, for example. The handle 200 can therefore be fixed about a second axis relative to the tool head 100, and wherein the first axis is orthogonal to the second axis.

Figure 6:
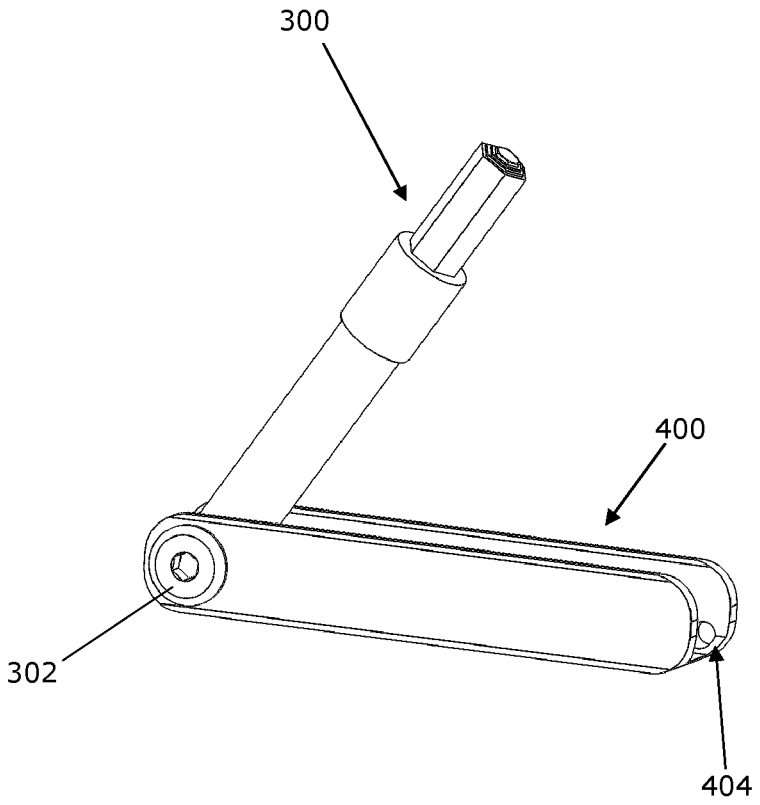
FIG. 6 is a perspective view of one side of another example tool head, according to another example embodiment.
Figure 7:
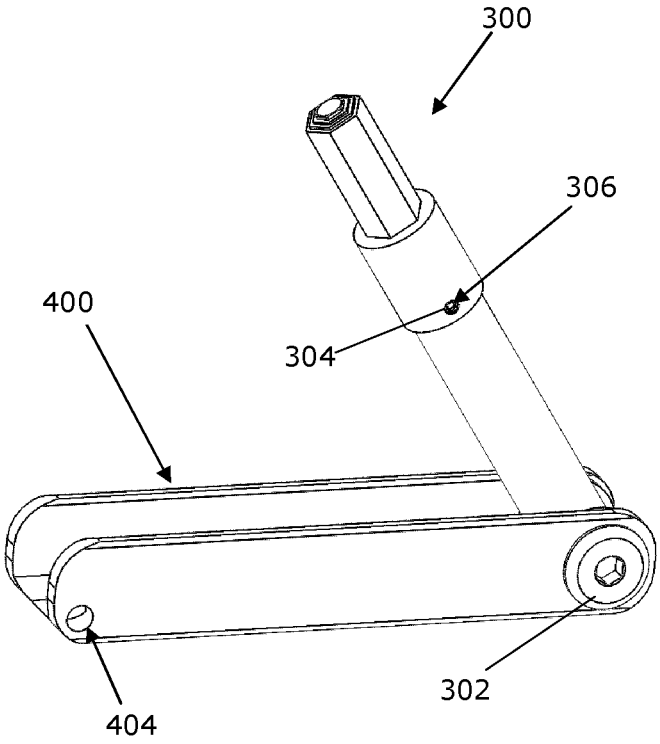
FIG. 7 is a perspective view of the other side of the tool head shown in FIG. 6.

FIGS. 6 and 7 illustrate another example tool head 300 and handle 400, according to another example embodiment. In accordance with example embodiments, the tool head 300 is similar to the tool head 100 and the handle 400 is similar to the handle 200, and similar reference numbers may be used for convenience of reference, with additional features as will be further described.

As shown in FIGS. 6 and 7, in an example embodiment, a fastener 302 such as an Allen head bolt and corresponding socket can be used to connect the tool head 300 with the handle 400, as shown. In an example embodiment, the fastener 302 itself provides a pivot between the tool head 300 and the handle 400. In an example embodiment, the fastener 302 can be removably detachable, for example using another hex key. In other example embodiments, the fastener 302 can be substantially permanently connected, for example using a rivet connection (not shown) or other suitable connection.

In an example embodiment, as shown in FIG. 7, a small set screw 304 can be screwed into a corresponding tapped hole 306 defined by the container piece 5 of the tool head 300, to engage the core 4 (FIGS. 1 and 2). The tapped hole 360 can have corresponding screw threads, in an example embodiment. In an example embodiment, the set screw 304 can further penetrate a corresponding aperture (e.g., as shown in FIG. 3) defined by the core 4. This, for example, assists in securing the core 4 to the container piece 5 and maintaining the relative positions.

In an example embodiment, a casing of the handle 400 can further comprise an aperture 404 or eyelet. The aperture 404 can be used, for example, to attach the handle 400 to other objects such as a bicycle, a keychain, a hook, a tool belt, etc.

Suitable materials for at least some components, shell(s), and/or solid core of the tool head 100 can include rigid materials which can withstand the resultant torsional forces when in operation. In some example embodiments, such materials can include hardened tool steel or stainless steel, etc.

In an example embodiment, a use or method of the tool head 100 is provided. The method includes: engaging the tool head 100 with a socket; retracting one or more shells 1, 2, 3, of the tool head 100 against a respective biasing member (e.g. coil spring 9) due to the engagement of the tool head with the socket, wherein at least the inner core 4 and possibly one or more of the shells 1, 2, 3 remains within the socket; and rotating the tool head 100 to rotate the socket.

In another example embodiment, six shells can be used on one tool, for example 2 mm, 2.5 mm, 3 mm, 4 mm, 5 mm, and 6 mm. In an example embodiment, these sizes could be split into two shafts or tool heads, or on opposing ends of the same shaft. For example, 2 mm, 3 mm, 5 mm are on one end or side and 2.5 mm, 4 mm, and 6 mm are on the other end or side.

In some examples, the disclosed tool head may provide better performance than conventional telescoping tool designs. The use of a solid core in the disclosed tool head, for example, may enable simpler, faster and/or less costly manufacture. The use of a solid core, for example, may also provide better transmission of torsional force than long hollow sections as in the conventional telescoping tools. In the disclosed tool head, for example, no hollow shell is torsionally loaded without both ends of the shell length being supported internally (by the solid core and by any inner shells) and/or externally. For example, when the second largest shell is under load, torsion from the distal end where it engages the socket is transmitted internally through the smaller inner shell(s) to the solid inner core. Remaining torsion from the second largest shell is transmitted to where the second largest shell contacts the core itself at the proximal end of the shell, and also transmitted to the depressed largest shell that partially encases the second largest shell and thus transmitted to the core via the largest shell. This configuration may help to reduce the strength requirements of the shells, which may help to improve manufacturability.

In an example embodiment, the tool head 100 is mounted onto a motor-controlled rotary tool, for semi-automated or automated use of the tool head 100.

The example embodiments described above are intended to be examples only. Example embodiments may be embodied in other specific forms. Alterations, modifications and variations to the example embodiments may be made without departing from the intended scope of the present disclosure. While the systems, devices and processes disclosed and shown herein may comprise a specific number of elements/components, the systems, devices and assemblies could be modified to include additional or fewer of such elements/components. For example, while any of the elements/components disclosed may be referenced as being singular, the embodiments disclosed herein could be modified to include a plurality of such elements/components. Selected features from one or more of the above-described embodiments may be combined to create alternative embodiments not explicitly described. All values and subranges within disclosed ranges are also disclosed. The subject matter described herein intends to cover and embrace all suitable changes in technology.

The invention claimed is:

1. A tool head comprising:

an inner core having a proximal end and a distal end, and defining a longitudinal axis; and a plurality of nested shells fitted over the inner core and substantially sharing the longitudinal axis of the inner core, each shell being engaged with the inner core at a proximal end, and each shell being independently biased towards the distal end of the inner core and independently compressible away from the distal end;

wherein each shell is independently slidable relative to the inner core and relative to each other.

2. The tool head of claim 1, further comprising: a plurality of biasing members, each biasing member being engaged with the inner core and with the proximal end of a respective one of the plurality of shells, each biasing member biasing the respective shell towards the distal end of the inner core.

3. The tool head of claim 2, wherein each biasing member is fixed at its proximal end to the inner core and at its distal end to the respective shell.

4. The tool head of claim 2, wherein each biasing member comprises a spring.

5. The tool head of claim 1, further comprising: a shell retention mechanism restricting distal movement of each shell.

6. The tool head of claim 5, wherein the shell retention mechanism for a given shell comprises a pin coupled to the given shell, the pin being slidable in a corresponding slot defined in the inner core, wherein range of movement of the pin in the slot defines range of movement of the given shell.

7. The tool head of claim 1, further comprising an outer container piece fitted over the inner core and covering at least a portion of an outermost one of the plurality of shells.

8. The tool head of claim 1, wherein each of the inner core and the plurality of shells has a hexagonal cross-section.

9. The tool head of claim 1, wherein the inner core has a stepped longitudinal cross-section, each of the plurality of shells being engaged by a respective step of the cross-section.

10. The tool head of claim 1, wherein the tool head is dimensioned to engage with socket fasteners found on a bicycle.

11. A tool comprising:

the tool head of claim 1; and a handle coupled to the tool head at a proximal end of the tool head.

12. The tool of claim 11, wherein the handle is rotatably coupled to the tool head, to enable the handle to fold over the tool head.

13. The tool of claim 11, wherein the handle is rotatably fixed to the tool head about an axis, to enable leverage from the handle to the tool head.

* * * * *